US005970902A

United States Patent [19]

Francis

[11] Patent Number: 5,970,902

[45] Date of Patent: Oct. 26, 1999

[54] ANCHORS

[76] Inventor: Rex William Francis, 27 Dunstan Road, Avonsleigh, 3182, Victoria, Australia

[21] Appl. No.: 09/149,824

[22] Filed: Sep. 8, 1998

[30] Foreign Application Priority Data

Sep. 10, 1997 [AU] Australia ..... 9103
Dec. 31, 1997 [AU] Australia ..... 1193

[51] Int. Cl.[6] ..... B63B 21/32

[52] U.S. Cl. ..... 114/301; 114/294

[58] Field of Search ..... 114/294, 295, 114/297, 299, 301, 303

[56] References Cited

U.S. PATENT DOCUMENTS 5,188,055 2/1993 Kershner ..... 114/299
5,396,858 3/1995 Francis ..... 114/301

FOREIGN PATENT DOCUMENTS 3639023 6/1987 Germany ..... 114/301
1356259 6/1974 United Kingdom ..... 114/301

*Primary Examiner*—Jesus D. Sotelo
*Attorney, Agent, or Firm*—Notaro & Michalos P.C.

[57] ABSTRACT

The present invention provides an improved anchor which is capable of being readily laid, regardless of the holding, and which will automatically reset itself in the instance of it being dislodged from the holding. The anchor includes a base member, preferably substantially triangular-shaped when viewed in plan and V-shaped when viewed in end elevation, a shank member associated with the base member and stabilizing means, preferably in the form of a hoop member, which is attached to the base member and/or the shank member, the stabilizing means serving to ensure that the anchor, once laid or set, will return to its operating disposition even if dislodged or displaced therefrom.

23 Claims, 3 Drawing Sheets

50
5
50
4
6
7
20
8
3
50
5
50

20
21
6
7
50
8
9
3
10
8
5
5
50
8
10
4
7
9
6
50
5
22
3
21
20

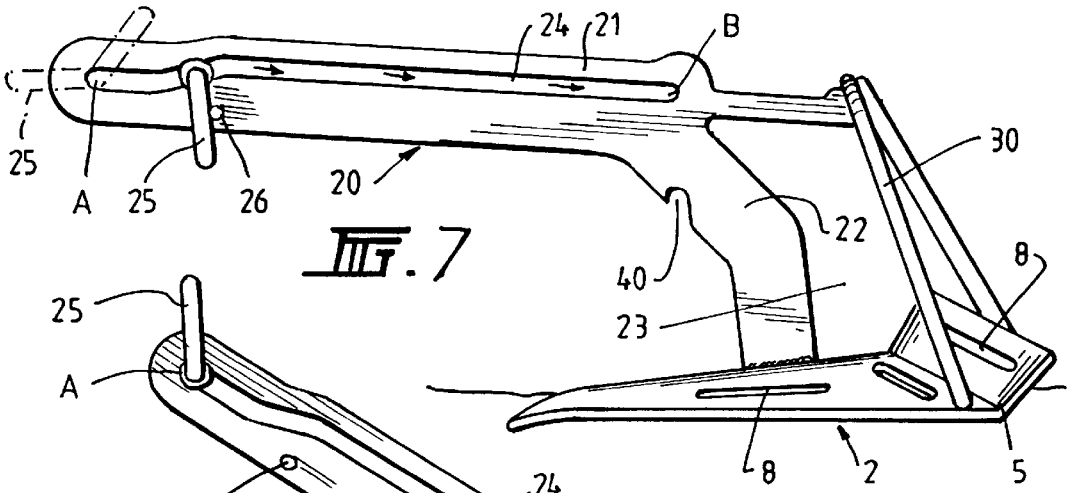
FIG. 7
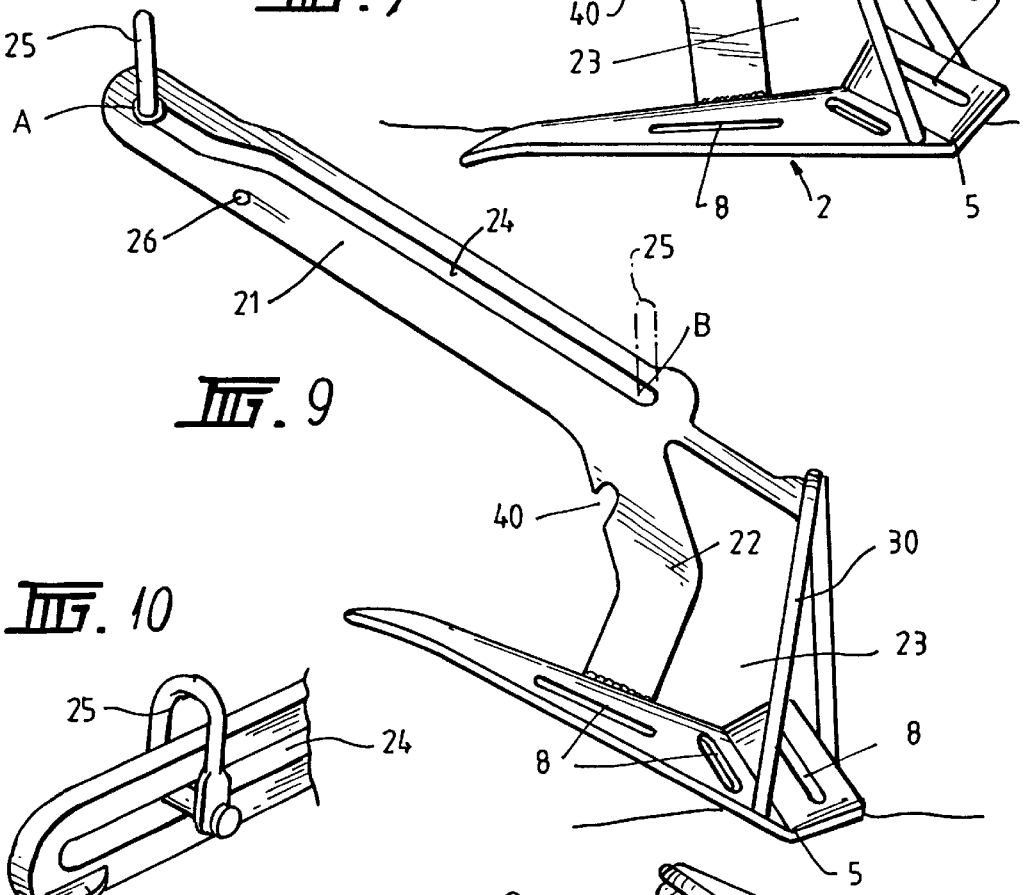
FIG. 9
FIG. 10
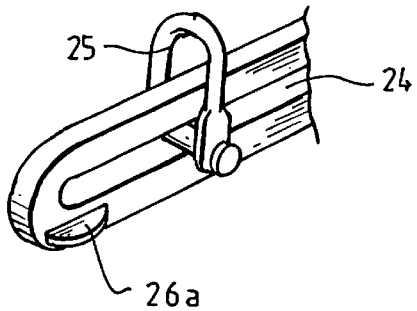
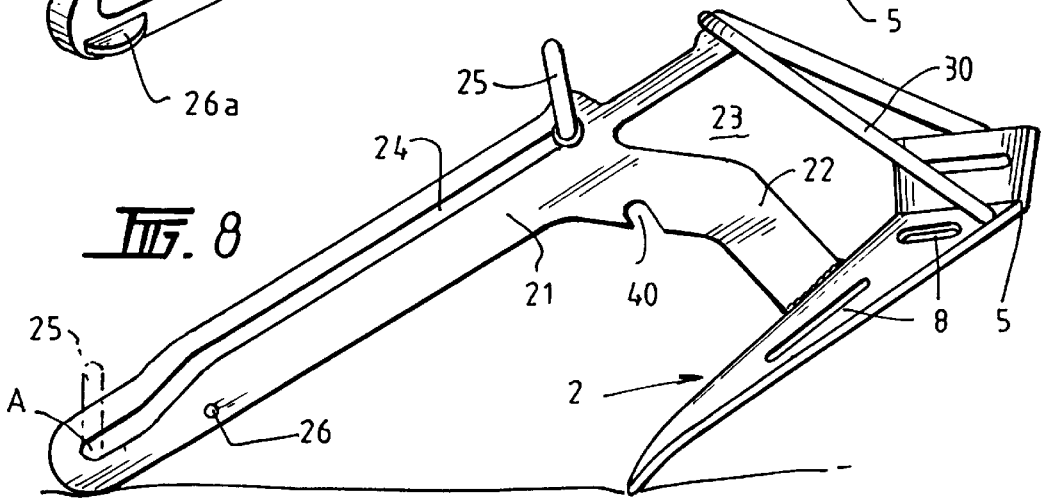
FIG. 8

ANCHORS

FIELD OF THE INVENTION

The present invention relates, in general terms, to improvements in anchors or means for anchoring. More particularly, but not exclusively, the invention relates to an improved form of anchor which lends itself to usage in a variety of different contexts, The anchor in accordance with the present invention affords increased safety and security in operation yet, when compared with known and currently in use anchors, is cheaper to manufacture—by virtue of its involving fewer individual parts or components—is easier to use and, at the same time, is remarkably environmentally friendly. The anchor in accordance with the present invention furthermore, by its very construction, is adapted to be automatically re-set in the instance, for whatever reason, of the anchor being released from, or working its way free from, any given anchorage.

Throughout the ensuing description particular reference will be made to especially preferred embodiments of an anchor in accordance with the present invention, employed for purposes of anchoring a boat or the like water-borne craft at a given locale. It should be realised, however, that the ensuing description refers merely to especially preferred embodiments of an anchor in accordance with the invention, and that under no circumstances should the present invention be considered to be limited to the preferred embodiments specifically described and illustrated. Indeed, an anchor or anchoring means in accordance with the present invention is equally suited for other purposes than the mooring of boats, as for example permanent or temporary mooring of buoys, drilling rigs and the like. It should be furthermore realised that the anchor or anchoring means in accordance with the present invention is usable regardless of the nature of the underwater terrain below the relevant craft, hereinafter referred to as "the holding", be such holding in the form of sand, mud, gravel, rock or even coral.

DESCRIPTION OF THE PRIOR ART

There has always existed a need to anchor or moor boats, buoys, drilling rigs and any other form of water-craft, either permanently or temporarily, in a given position. That need has, in turn, given rise to problems by virtue of the fact that, dependent upon circumstances and location, it has become necessary to anchor or moor such craft in different types of holdings. In the past it has been found that an anchor which might be particularly suitable for one type or form of holding, as for example sand or mud, may not be appropriate for another or different type of holding, as for example rock or coral. In accordance with the known art, therefore, it has been a common practice to utilise a different form of anchor dependent upon the nature of the holding. In accordance with the known art there has not been available a multi-use, multi-purpose anchor. In the result, and in order to achieve the best or optimum anchoring result, a different form of anchor would need to be employed dependent upon the nature of the holding. That fact alone gave rise to problems, regardless of the size of the water-borne craft or the like to be anchored. In practical terms it was not particularly efficient to have the craft operator required to change the anchor to a different type dependent upon circumstances and the nature of the holding below the craft, this in terms of cost-effectiveness, efficiency, ease of storage, etc.

Again in accordance with the known art there has been a tendency for conventional anchors, if disturbed, to roll over and thereafter be disposed on the ocean/sea/river/lake bottom (or holding) incorrectly, in effect the wrong way up. In reality prior art anchors, when so disturbed, would lay on their side and had a tendency to stay that way. Quite clearly when in such a configuration the efficiency of operation of the overall anchor is seriously reduced, a totally unacceptable result. Furthermore, when in such a configuration there will be a tendency for the anchor to be dragged across the holding, giving rise to disturbance of sand, mud, dislodgment of rock, destruction of coral etc. Such can have a deleterious effect on the overall environment and, if the relevant craft is being used, for example, for purposes of angling or fishing, such a disturbance to the holding/ocean bottom is again undesirable.

A further problem/disadvantage encountered by or associated with anchors in accordance with the known art has also related to the tendency or possibility of such anchors inadvertently working their way free from the holding, regardless of the nature of such holding. Once an anchor works itself free from its holding then the vessel or craft associated therewith is totally susceptible to the vagaries of the tides, weather, etc. This can be especially unfortunate if, for example, the crew or passenger(s) of the vessel or craft are not aware of the fact that the anchor has worked loose, as for example if they are sleeping or otherwise occupied. An unanchored vessel can drift alarmingly, dependent upon the tides and the prevailing weather conditions, leaving itself liable to all sorts of consequences, as for example beaching, being swept onto rocks or reefs, etc. In other words, one consequence of an anchor working itself free from its holding can involve significant danger to the occupants of the vessel or craft.

SUMMARY OF THE INVENTION

The present invention seeks to overcome the problems and disadvantages associated with the prior art by providing a form of anchor which lends itself to ready use regardless of the nature of the holding, includes fewer component parts and is hence both easier and cheaper to manufacture, exhibits an inherent ability to right itself or assume/resume the desired configuration even when disturbed, and yet affords increased safety end security, not to mention ease of overall operation/installation. The present invention also provides an improved form of anchor which is in fact automatically re-settable, being an anchor which re-sets itself in the instance of it having worked loose from its holding. Furthermore, and by utilising the minimum number of moving parts, the anchor according to the present invention is not in itself readily susceptible to breakdown.

In accordance with a first aspect of the present invention there is provided an improved anchor including; a base member; a shank member attached to said base member and adapted to receive, and releasably retain, at least one anchor cable, chainrope or the like; and stabilizing means adapted to be attached to said base member, said stabilizing means serving to ensure that said anchor readily assumes it operating configuration and/or is restored to said operating configuration, even after having been disturbed therefrom.

In accordance with a further aspect of the present invention there is provided an improved automatically re-settable anchor, including; a base member; a shank member fixedly attached to said base member and adapted to receive, and releasably retain, at least one anchor cable, chainrope or the like; stabilizing means adapted to be attached to said base member, said stabilizing means serving to ensure that said anchor readily resumes its operating configuration, and/or is restored to said operating configuration, even after having been disturbed therefrom, and wherein said shank member includes means allowing for re-setting of said anchor.

In one embodiment, the stabilizing means is in the form of a hoop member which is releasably attachable to said base member, thereby to be readily removable thereupon to facilitate storage of the anchor when not in use. In an alternative embodiment, the hoop member may be fixedly and permanently attached to the base member.

DESCRIPTION OF THE DRAWINGS

In order that the invention may be more clearly understood and put into practical effect there shall now be described in detail preferred embodiments of an anchor in accordance with the invention. The ensuing description is given by way of non-limitative example only and is with reference to the accompanying drawings, wherein:

FIG. 7 is a side elevational view of yet a further embodiment of an anchor in accordance with the present invention, including a first embodiment of a re-setting means;

FIG. 8 is a view, similar to FIG. 7, but showing the anchor in the configuration where it has worked its way loose from its holding;

FIG. 9 is a further view, again similar to FIG. 7, but showing the anchor in a configuration suitable for re-setting or re-bedding in its holding; and FIG. 10 is a sectional view of the shank of an anchor in accordance with the present invention, including therein an alternative embodiment of a re-setting means.

DESCRIPTION OF PREFERRED EMBODIMENTS

Figure 1:
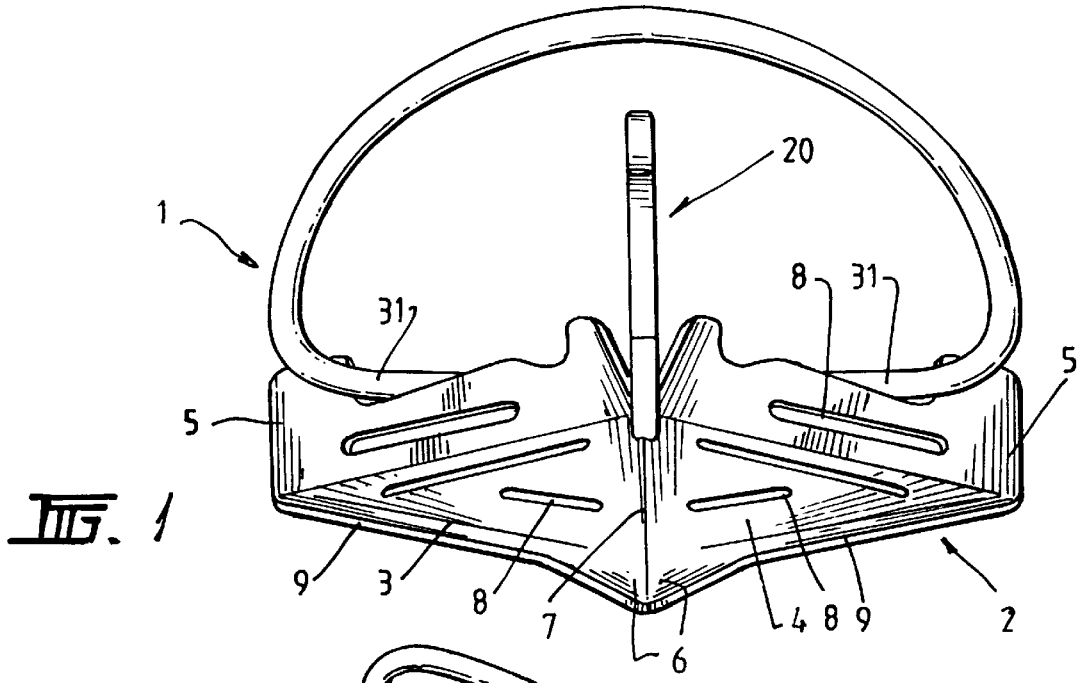
FIG. 1 is a front perspective view of a first embodiment of an anchor in accordance with the present invention.
Figure 2:
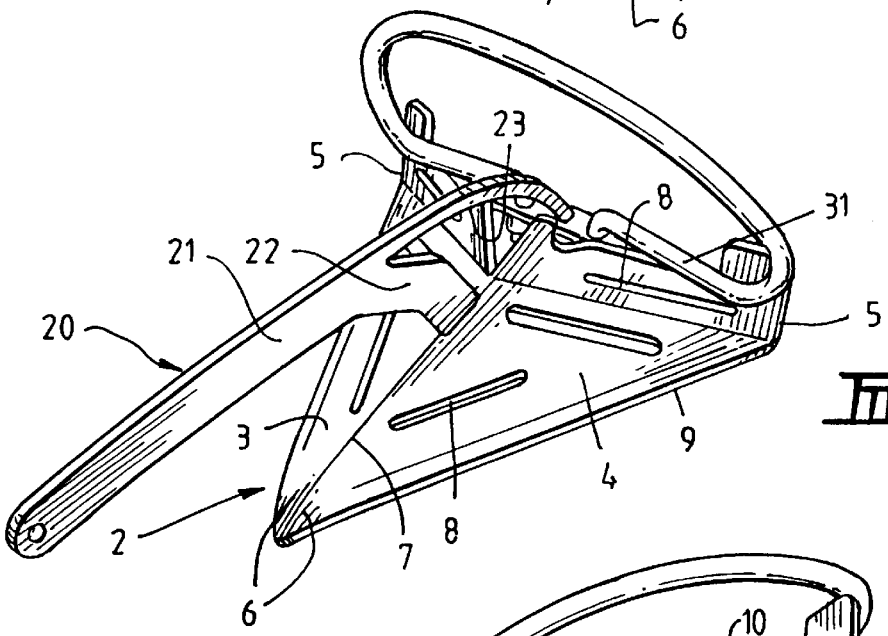
FIG. 2 is a top elevational view of the anchor of FIG. 1.
Figure 3:
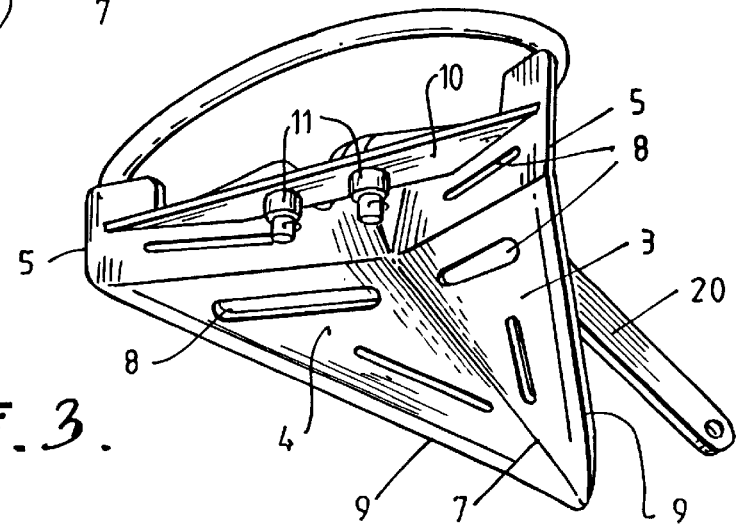
FIG. 3 is a bottom perspective view of the anchor of FIG. 1.

In the preferred embodiments illustrated the anchor, generally designated 1, is preferably of a shape which is substantially symmetrical about a central vertical plane (see FIG. 1). As illustrated the anchor 1 includes a base member 2 formed of opposed wing members 3 and 4, each of a substantially triangular shape or v-shape when viewed in plan and having, at one end, a further member 5 projecting upwardly and rearwardly therefrom at an angle other than 90°. Each wing member 3 and 4 also has, at or in the vicinity of the vertex thereof, a portion 6 turned downwardly from the overall plane of each member 3 and 4 whereby to provide, at the leading end of the base member 2, a top portion whose function is to facilitate the digging of the overall anchor 1 into the ocean bottom or holding, thereby to ensure proper anchorage. In the preferred embodiments illustrated the wing sections 3 and 4 each have the longest side thereof constituting a free side edge of the overall anchor 1. The two wing members 3 and 4 are joined along one side thereof, at an angle one to the other, so as to form a ridge 7 along the line of join. In the preferred embodiments illustrated the two wing members 3 and 4 are non-planar, being disposed at an angle one to the other such that, when viewed in end elevation, the base member 2 thus formed thereby is substantially v-shaped.

The base member 2 is preferably formed from a single sheet of metal, in any known manner and using any known apparatus, as for example by pressing or stamping. It should be realised, however, that the method of construction does not constitute part of the invention. The base member 2, of a substantially triangular shape when viewed in plan, in fact has a shape similar to that of the blade of a shovel, spade or the like, and functions accordingly—this in marked contrast to prior art plough type anchors, which served or acted not only to penetrate the surface of the holding but also to plough or turn over the material thus disturbed. The present applicant's arrangement, however, merely penetrate the surface of the holding and serve to bed itself therein.

The wing members 3 and 4 of the base member 2, and the rearwardly projecting members 5, each include one or more slots 8 therein, themselves being responsible for certain practical advantages. Firstly, they reduce the overall surface area of the anchor 1, more specifically the base member 2 and associated members 5, assisting in rapid sinking of the anchor 1 by allowing passage of water there-through. Secondly, when the anchor 1 is in place in the holding the slots 8 assist in breaking of the suction which exists and acts to keep the anchor in place, thereby facilitating release when desired. Thirdly, and this most especially when in use in rough seas and/or windy weather, the slots 8 give rise to a pumping action moving sand, mud, etc from under the anchor, hence providing a better anchorage. Furthermore, and especially since the base member 2 is substantially v-shaped rather than flat (when viewed in end elevation), the slots 8 allow the water/current to in effect wash that member 2, minimising the possibility of undesirable fouling thereof.

Extending laterally of the anchor 1 towards the rear end (the non-toe end) thereof is a bracing member 10 having a plurality of sleeves 11 attached thereto and integral therewith, preferably symmetrically of the centre line thereof, for a reason to be explained hereinafter.

The anchor 1 in accordance with the present invention furthermore includes a shank member 20 which is fixedly attached thereto by any suitable means, as for example by welding. The shank member 20 is separately attached to the base member 2 and to the bracing member 10. In the especially preferred embodiments illustrated the shank member 20 includes an arm portion 21, preferably extending substantially parallel to the base member 2 of the anchor 1 and spaced therefrom, and a leg portion 22 attached to the base member 2, with the leg portion 22 of that shank member 20 having a substantial void or discontinuity 23 therein. Such void or discontinuity 23 serves to reduce the overall weight of the anchor 1, yet at the same time increases the effectiveness thereof in a manner to be explained hereinafter.

The arrangement in accordance with the present invention furthermore includes means, preferably releasably connectable thereto, serving to assist in balancing or self-righting of the overall anchor 1. In an especially preferred embodiment such balancing or self-righting means can take the form of a shaped hoop 30, substantially semi-circular as shown, including substantially radially disposed opposed arm members 31 the free ends of which are adapted, in use, to be received and releasably retained within the sleeves 11 provided in the bracing member 10.

In an especially preferred embodiment the hoop/self-righting means 30 is disposed upwardly, at an angle other than 90°, to the base member 2. More especially, the hoop 30 preferably is at an angle of greater than 60° and less than 80° to the base member 2. This configuration ensures that the anchor always tends to assume its required orientation.

According to one preferred embodiment of the present invention, the self-righting means 30 is releasably attachable to the base member 2. In an alternative embodiment, as shown for example in FIGS. 7 to 9, the hoop 30 will be fixed to the anchor using any suitable means, as for example welding. As shown in FIG. 7, for example, the self-righting hoop means 30 is fixed to the shank 20 as shown, and also to opposed sides of the base member 2. Such a configuration affords improved rigidity and/or strength to the hoop 30 itself.

The arm portion 21 of the shank member 20, as shown particularly in FIG. 7, includes a shaped slot 24 extending longitudinally thereof, such slot 24 being adapted to receive, and preferably releasably retain, a shackle or the like means, as for example a D-shackle 25. In use, the anchor 1 in accordance with the present invention is intended to be embedded in the relevant holding. In the instance, however, of the anchor 1 becoming disengaged from its holding, then the D-shackle 25 will act to run along the slot 24, in the direction of the arrows from the end designated A thereof and until such time as it impacts with the end B thereof. In that regard it should be understood that, whilst this procedure of course occupies a finite time, in real terms the D-shackle 25 impacts with the end B of the slot 24 with quite a substantial force. As illustrated in FIGS. 7 to 9, in one embodiment the slot 24 includes opposed substantially flat end portions joined by a sloping or sloped intermediate section.

In one embodiment, as shown in FIGS. 7 to 9, strategically placed along the length of the arm portion of the shank 20, at or in the vicinity of the free end thereof, is a protrusion 26 of any given type and shape (as for example a pin or the like). This protrusion 26 acts, in use, to prevent the D-shackle 25 from moving along or falling down the shank 20, more particularly along the underside thereof. In that regard it should be realized that, if such was allowed to happen, then a consequence thereof would be that the shackle 25 and its associated chain, cable, chainrope or the like (collectively referred to as anchor line and (not shown) could become jammed or fouled on the shank 20, hence preventing correct orientation of the fluke (anchor).

In an alternative embodiment, see FIG. 10, the slot 24 is substantially flat along the entire length thereof, with no sloping intermediate or joining section. Furthermore, and rather than employing a protrusion to prevent jamming or fouling of the D-shackle 25 and its associated chain, a shaped member 26*a* is provided at or in the vicinity of the end of the shank 20. This shaped member 26*a* also acts to prevent the D-shackle 25 from travelling around the free end of the shank 20.

By virtue of the overall shape and configuration of the anchor 1, which can be seen to have the bulk of its weight, and indeed the hoop 30 thereof, at the end thereof remote from the free end of the shank 20, the impact of the D-shackle 25 against the end B of the slot 24 causes (or more correctly forces) the anchor 1 to be tipped up into the position shown in FIG. 9. When in that position or configuration, the D-shackle 25 then runs in the reverse direction along the slot 24, to return to the end A thereof, and causing the overall anchor to be brought back to the position shown in FIG. 9, lifting the back of the anchor, thereby allowing the overall anchor 1 to re-set itself in the holding. It should be realised that this entire operation takes place automatically, without any need for human intervention. This is in marked contrast to the prior art procedures previously employed, which required retraction of the anchor to the surface, and then subsequent re-setting thereof.

In accordance with a further aspect of the present invention there is provided, in the leg portion 22 of the shank 20, a notch or the like discontinuity 40 as shown. Such notch 40 serves the following purpose.

In accordance with known arrangements and techniques en anchor and its associated chain, as attached to any vessel or craft in any known manner, can be associated with a buoy or the like means—intended to float on the surface-having a ring means or the like associated therewith, with the chain passing through the ring, to the vessel, via the buoy. One practice, to allow a boat/vessel to shift position, involves releasing the anchor from its holding—in any known manner—and then motoring or moving the vessel, preferably in a circular path. This serves to bring the anchor to the surface, via the ring means and buoy. The notch 40 in the leg portion 22 of the shank 20 of an anchor 1 in accordance with the present invention acts to catch, or become engaged with, the said ring means, thereby retaining the anchor 1 in position, at or in the vicinity of the surface relative to the buoy, in fact facilitating retraction or retrieval of the anchor as and when desired.

The principle of operation of the anchor or anchoring means in accordance with the present invention, and the practical advantages attributable thereto, will now be explained in more detail.

First of all it should be realised that the anchor in accordance with the present invention, by virtue of its very shape, represents a unique combination when compared with the known and currently in use arrangements. More particularly the triangular-shaped base member 2, with its one penetrating point, is responsible for markedly improved anchorage. The very fact that the base member illustrates a substantial v-shape when viewed in side elevation in itself is responsible for an advantage, with water pressure acting on the large surface area presented by the base member 2 itself to assist in driving the overall anchor deeper into the holding, thereby to afford remarkably improved anchorage.

The self-righting means as employed with the present arrangement provides the overall anchor with a new type of orientation or disposition when in use, and is in fact responsible for maintenance or resumption of such orientation or disposition, even in the instance of the anchor being disturbed therefrom (for whatever reason). With more conventional anchors, if for example they were placed in the water the wrong way up or incorrectly disposed, then they would stay in such a configuration, with a resultant loss of anchorage. The arrangement in accordance with the present invention overcomes such a problem through its capability of resuming the correct orientation in the shortest possible period after disturbance thereof.

The self-righting means or hoop-like element also assists in usage of the anchor, by giving the boat owner something positive to grip on. Such facilitates both the deployment and the recovery of the anchor. In fact, the present anchor allows for two-handed gripping, with one hand on the shank and the other on the hoop/self-righting means. The advantages of such a two-handed grip, when compared with the one-handed grip (on the shank) usable with the prior art anchors, in terms of ease of use, should be self-evident.

Figures 4, 5, 6:
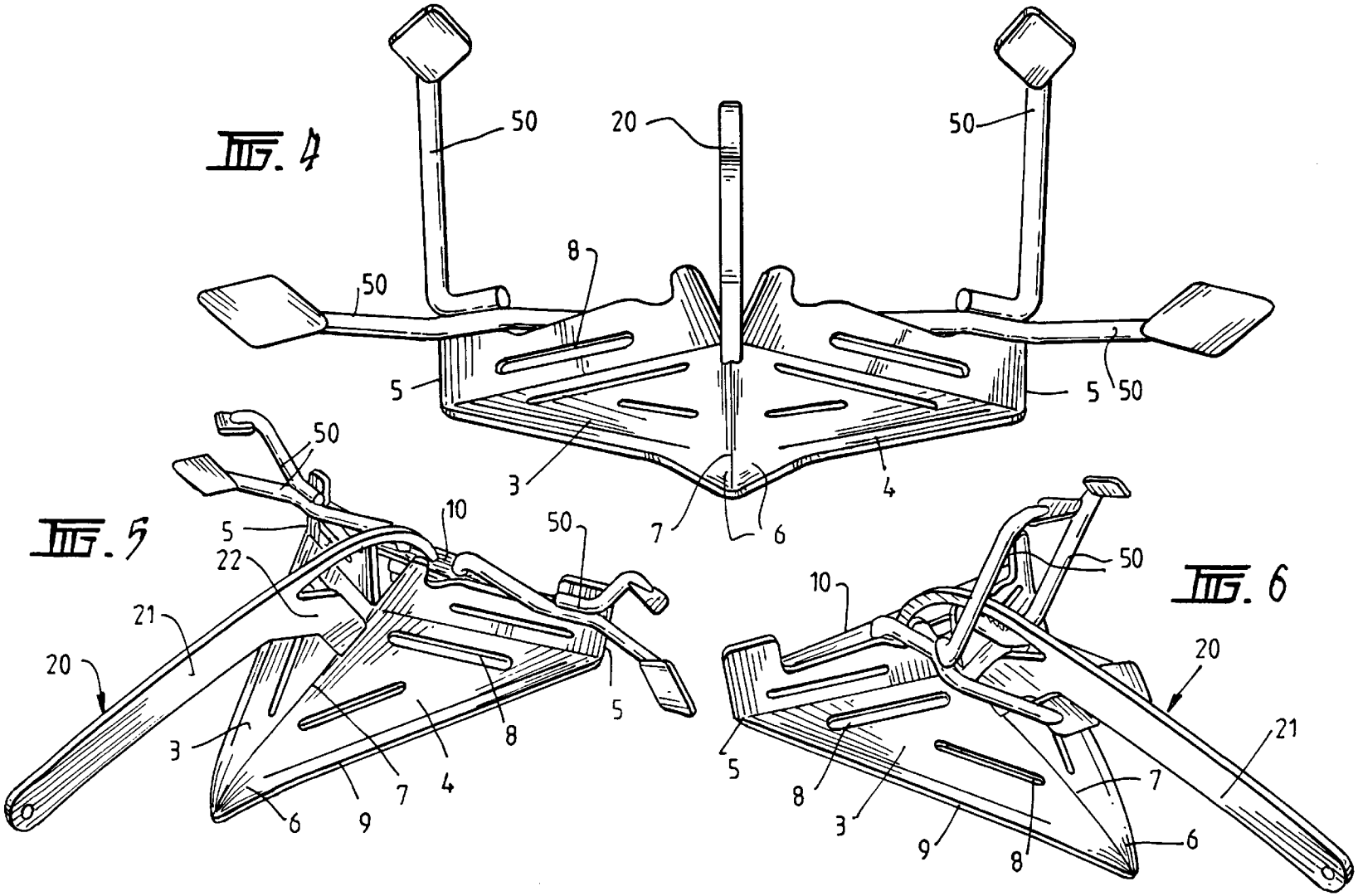
FIG. 4 is a front perspective view of an alternative embodiment of an anchor in accordance with the present invention, including a plurality of tines located thereon.
FIG. 5 is a top elevational view of the anchor of FIG. 4.
FIG. 6 is a further view of the anchor of FIG. 4.

In an especially preferred embodiment, as illustrated in FIGS. 4 to 6, an anchor 1 in accordance with the present invention can have a plurality of reef tines 50 fitted thereto. The tines 50 are adapted to be releasably insertable into the sleeves 11 provided in the bracing member 10 of the anchor base member 2. Preferably such tines 50 are removable when not needed.

The base member 2 of the anchor 1 in accordance with the present invention is other than flat, involving as it does a substantial v-shape when viewed in side elevation. Such a configuration is responsible for a pumping action, which serves first of all to assist in burying of the anchor in the holding and, secondly, acts to fill in any trench formed behind the anchor. In practical terms the quicker an anchor penetrates the holding to assume its required anchorage, then the less is the damage to the surrounding environment.

Preferably, at or in the vicinity of the free side edges of the overall anchor is a portion of each wing member 3 and 4 which is bevelled, as at 9. That bevelled edge is in itself responsible for an important practical or in-use advantage for the anchor. In use, when the anchor itself—via its leading or toe end—commences to dig itself into the holding—sand, dirt or the like is moved towards the rear of the anchor. The bevelled section of the base member 2 creates a locking effect, guiding sand, dirt, etc over the top surface of the base member 2 itself, thereby to fill in any trench or ditch previously formed by the digging in of the anchor. Once the anchor has commenced digging in to the holding, the bevelled side edges also serve to direct dirt, sand etc onto the top surface of the base member 2, adding more weight to the overall anchor, hence further augmenting the anchorage achieved thereby.

The arrangement in accordance with the present invention, with its unique operating configuration or orientation when compared with known anchors, exhibits an important advance in terms of deshackling. Prior art anchors generally use a ring or the like means to attach a chain deshackling means, generally in the form of lashing of any known type. Such were pulled from the rear, which resulted in the anchor tumbling—an undesirable result indeed. This is especially significant if a boat is anchored in an area where the holding is coral, for example. Prior art arrangements exhibited a tendency to stick or be caught in the holding, with release of the anchor then becoming a difficult, time-consuming and often frustrating task.

With the anchor in accordance with the present invention however, there is a different location for any deshackling means, which can then be lashed—by any suitable means—to an aperture (not shown) provided at or in the vicinity of the free end of the arm of the shank. In the instance of the anchor becoming stuck in the holding, then by simply driving the boat back over the anchor the lashing will be snapped/severed, thus allowing the anchor itself to be dragged upwardly, indeed moving the anchor in a rearward direction to effect release thereof from the holding. Alternatively, and even if the lashing was to be inadvertently broken, then the anchor would not be released from the holding until such time as the boat has actually been driven back over the anchor. This constitutes an extremely desirable safety feature, not evident with the prior art arrangements.

Prior art anchors had a tendency to lie on their side. If the holding is other than sand or mud, as for example coral, sea-grass, etc, such anchors can be choked up with sea-grass, etc in the area between the shank and the fluke, giving rise to a significant reduction in holding power. In contrast thereto, the anchor in accordance with the present invention cannot be on its side, lying only on its base—the self-righting means is responsible therefor. As such, the anchor will dig itself into the holding regardless of the nature/composition thereof.

As an extension of the above, prior art anchors more often then not, especially with a plough-type anchor, would be dragged across the holding until such time as they were able to, eventually, dig in and establish a footing. This in turn gave rise to undesirable damage to the holding. Since sea-grass, coral reefs, etc can constitute important spawning/breeding grounds, such damage caused by a dragging plough anchor could have serious consequences for the environment/ecology, etc. In contrast thereto, the anchor in accordance with the present invention causes minimal, in fact negligible, damage to the holding, Furthermore, the configuration as illustrated is not prone to choking with weed, sea-grass or the like.

With the arrangement in accordance with the present invention, the bulk of the weight thereof is disposed at or towards the rear, rather than the toe, end. With such a configuration, when the toe end strikes the holding, and the overall anchor shows a tendency to stand up, then the very fact that the bulk of the weight is concentrated in the rear serves to assist in bedding in of the anchor. In contrast to some prior art arrangements, the anchor in accordance with the present invention does not require a heavy duty or heavy weight shank member to function properly. Indeed, the arrangement in accordance with the present invention is lightweight, when compared with the prior art, yet operates with greatly enhanced effectiveness.

The very shape of the base member of the anchor in accordance with the present invention is responsible for further practical advantages, in terms of the setting or laying thereof. Once the anchor in accordance with the present invention is dropped into the water, its aerodynamic shape will initially at least, cause it to float momentarily. In the result, the chain associated therewith will drop to the bottom first, then serving to drag the anchor down behind it. Such then means that, once set, the anchor lays on top of the chain. This is in marked contrast to the prior art arrangements, which exhibit a tendency to have the chain drop onto and lay over the anchor, hence giving rise to the possibility of the chain becoming entangled with or fouling the anchor. If the chain fouled the anchor, the release thereof may be difficult to achieve. The arrangement in accordance with the present invention, by avoiding this possibility of fouling, ensure proper release of the anchor from its holding as and when desired. The practical ramifications thereof, in terms of safety, should be apparent.

In contrast to known and more conventional anchors, the anchor in accordance with the present invention does not require any extra length of chain or any form of dead-weight. With more conventional anchors, in order to ensure appropriate anchorage either an additional length of heavy chain, or some other form of dead-weight, may be employed. Such prior art arrangements have been found to be unwieldy, inefficient, overly expensive and in fact difficult to operate. The elimination of the need for any extra length of chain or other form of dead-weight is of significant practical importance.

The arrangements in accordance with the present invention represent a full combination anchor, suitable for use regardless of the nature of the holding. Such arrangement affords the boat user increased safety and security. This is nowhere more evident, or necessary, than in a situation wherein a change in the weather is imminent. Unless, in such a situation, adequate anchorage is possible and achievable, then it may be best for the boat owner to run for covert. If the effect of any such change is short-lived, then to all practical purposes it would have been more appropriate to drop anchor and wait it out. However, if there is some uncertainty as to the security of the anchorage, then there is an inherent danger in such a practice. With the arrangement in accordance with the present invention, with its significantly improved anchorage, the options available to the boat owner are greater.

The arrangement in accordance with the present invention also has the advantage, when compared with the prior art, of being capable of being used as a drogue or sea anchor. Such drogues or sea anchors are usable to afford the pilot of any boat improved or better control in heavy seas, for example. The arrangement is such that, if intended to be used as a drogue or sea anchor, the anchor in accordance with the present invention is played out from the boat, without being allowed to touch the sea bottom, with the hoop or self-righting means disposed downwardly. In other words the anchor in accordance with the present invention is, in such a usage or context, disposed upside down behind the boat. The "aerodynamic" shape of the overall base member of the anchor then acts to force the anchor upwardly such that the anchor tends to "surf" behind the boat along the surface of the water. This has been found to be especially the case when boat speed is of the order of 10 knots or more. The drag afforded by the anchor so disposed gives to the pilot/driver of the boat a greater degree of control over the movement thereof. It should also be realised that, when thus "surfing" behind the boat, it is possible relatively easily for the anchor to be dragged fully into the boat without having to stop the boat itself, this in contrast to prior art sea anchors. By "surfing" on the surface of the sea, the anchor will not run foul of motors and other protuberances on the boat itself.

Since the present applicant's arrangement is automatically self-setting, then the previously-mentioned problems associated with, or likely to be encountered by, an unanchored vessel are avoided.

Furthermore, the present applicant's arrangement does not necessitate the bringing of a released anchor to the surface for purposes of re-setting. This of course gives rise to improved operation, in terms of labour, time, etc. Such a capability is again in marked contrast to the known art.

Finally, end by virtue of the fact that there are a minimum number of working parts, the possibility of breakage, etc., is to all intents and purposes removed.

It is to be understood that the aforegoing description refers merely to preferred embodiments of an anchor or anchoring means in accordance with the present invention and that variations and modifications will be possible thereto without departing from the spirit and scope of the invention, the ambit of which is to be determined from the following claims.

I claim:

1. An automatically re-settable anchor for anchoring at a holding, the anchor comprising:

a base member having a substantial triangular shape when viewed in plan, with a vertex of said triangular shape constituting a leading end of said anchor adapted to assist in anchorage of said anchor within the holding, said base member being formed from two opposed wing members, each substantially triangularly shaped when viewed in plan, said opposed wing members being joined along a line constituting a center-line for said anchor, said wing members being disposed at an angle to one another such that when viewed in end elevation, said base member has a substantial V-shape, and wherein each of said wing members includes, at a leading end thereof, a down-turned portion which constitutes part of said leading end of said anchor for assisting in digging in of said anchor in the holding;

a shank member fixedly attached to said base member and adapted to receive and releasably retain, at least one anchor line;

stabilizing means releasably attached to said base member, said stabilizing means including a member which is substantially semi-circular in shape, said stabilizing means serving to ensure that said anchor readily assumes an operating configuration and is restored to said operating configuration even after having been disturbed therefrom; and means associated with said shank member for re-setting said anchor, said means for re-setting including a slot extending substantially longitudinally of said shank member and along at least part of a length of said shank member, said slot being adapted to receive and releasably retain, a shackle means for the anchor line.

2. The anchor as claimed in claim 1, wherein said stabilizing means is attached to both said base member and said shank member.

3. The anchor as claimed in claim 2, wherein said stabilizing member is fixedly secured to said shank member at a leading end of said shank member and to opposite sides of said base member.

4. The anchor as claimed in claim 3, wherein each wing member includes, at a trailing end thereof remote from said down-turned portion, a further member extending upwardly and at an angle to each respective wing member.

5. The anchor as claimed in claim 4, wherein said angle is other than 90°.

6. The anchor as claimed in claim 5, wherein each of said wing members includes at least one discontinuity therein.

7. The anchor as claimed in claim 6, wherein said further member of each said wing member includes at least one discontinuity therein.

8. The anchor as claimed in claim 7, wherein each wing member has a free edge constituting a side of said anchor and being beveled.

9. The anchor as claimed in claim 8, including a bracing member extending between said further members of said wing members, and at a rear of said further members.

10. The anchor as claimed in claim 9, wherein said bracing member includes a pair of sleeves symmetrically disposed along a length of said bracing member relative to the center-line of said anchor.

11. The anchor as claimed in claim 10, wherein said stabilizing means is in the form of a tubular member including a central portion having a substantially semi-circular shape and opposite arm portions extending substantially normally from opposed ends of said central portion, each said arm portion terminating in a downwardly turned free end received within one of said sleeves of said bracing member.

12. The anchor as claimed in claim 11, wherein said shank member is fixedly attached to both said base member and said bracing member.

13. The anchor as claimed in claim 11, wherein said stabilizing member is in the form of a tubular member having a substantially semi-circular shape with opposed free ends being fixedly attached to said bracing member.

14. The anchor as claimed in claim 1, wherein said shank member includes an arm portion extending substantially parallel to said base member, and a leg portion connected to said base member.

15. The anchor as claimed in claim 14, wherein said leg portion of said shank member includes at least one discontinuity therein.

16. The anchor as claimed in claim 1, including a plurality of tines releasably attachable to said base member and extending in a generally forward direction from said base member.

17. The anchor as claimed in claim 16, wherein there are a pair of such tines on each side of said base member, one of each said pair of tines being upwardly directed and the other of each said pair of tines being downwardly directed.

18. The anchor as claimed in claim 17, wherein said tines are mounted laterally outboard of said base member.

19. The anchor as claimed in claim 18, wherein said shackle means is free to move along said slot of said shank member responsive to changes in a disposition of said anchor relative to the holding.

20. The anchor as claimed in claim 19, including means for preventing said shackle means and an anchor line connected thereto from being disposed on an underside of said arm portion of said shank member to avoid fouling of said anchor by the anchor line.

21. The anchor as claimed in claim 20, wherein said means for avoiding fouling is at least one projection extending laterally from said arm portion of said shank member and located in a vicinity of a free end of said arm portion.

22. The anchor as claimed in claim 21, including at least one notch in an underside of said leg portion of said shank member.

23. The anchor as claimed in claim 21, including at least one slot in an underside of said leg portion of said shank member.

* * * * *